United States Patent [19]

Tanaka et al.

[11] Patent Number: 4,763,892

[45] Date of Patent: Aug. 16, 1988

[54] MOVABLE TRAY SHEET SORTER

[75] Inventors: Hajime Tanaka, Zushi; Tetsuya Okada, Machida, both of Japan

[73] Assignees: Clover Engineering Corporation, Kanagawa; Kyocera Corporation, Kyoto, both of Japan

[21] Appl. No.: 20,095

[22] Filed: Feb. 27, 1987

[30] Foreign Application Priority Data

Mar. 11, 1986 [JP] Japan ..... 61-51512

[51] Int. Cl.[4] ..... B65H 39/10

[52] U.S. Cl. ..... 271/293; 271/294

[58] Field of Search ..... 271/293, 292, 294

[56] References Cited

U.S. PATENT DOCUMENTS 3,938,802 2/1976 Hartman ..... 271/293 X 4,055,339 10/1977 Looney ..... 271/293

*Primary Examiner*—Richard A. Schacher

*Attorney, Agent, or Firm*—Spensley Horn Jubas & Lubitz

[57] ABSTRACT

This invention relates to a sorter for sequentially moving a plurality of vertically stacked storage sections to a sheet reception position by a moving mechanism which is pivoted upon reception of a rotational force from a drive, and for automatically sorting sheets discharged from an image forming apparatus into the storage sections. The moving mechanism is constituted by a link body, pivotal movement of the link member allows widening of a distance betwen two adjacent storage sections, and the plurality of storage sections connected by the corresponding regulating members can be moved to the sheet reception position, thereby making the sorter compact and achieving appropriate sorting without causing jam or the like.

7 Claims, 4 Drawing Sheets

MOVABLE TRAY SHEET SORTER

BACKGROUND OF THE INVENTION

I. Field of the Invention

The present invention relates to a sorter for sorting sheets discharged from an image forming apparatus such as a copying machine or a printer and, more particularly, to a sorter having a plurality of vertically stacked sheet storage sections and a moving means rotated upon reception of a rotational force from a driving means, the sorter being operated such that the plurality of sheet storage sections are sequentially moved to a sheet reception position while a distance between the currently operated sheet storage section and the next sheet storage section is increased by rotational movement of the moving means.

II. Description of the Prior Art

In a conventional sorter, vertically stacked sheet storage sections are sequentially moved to a sheet reception position of a sheet discharged from an image forming apparatus and the sheets with copied images are selectively sorted on the sheet storage sections. Conventional sorters of this type are designed to be attached to a corresponding image forming apparatus. For this reason, various techniques have been proposed to make the sorters compact and minimize their installation space so as to reduce the occupation space of a system including an image forming apparatus and a sorter.

Japanese Patent Disclosure (Kokai) No. 59-74856 describes the following technique (to be referred to as a first prior art hereinafter; see FIG. 6 of the first prior art). According to this technique, a plurality of bin trays serving as sheet storage sections are vertically stacked, and a rotary belt-like lift mechanism for moving the (lowermost bin—1) bin trays upward to a sheet reception position and a pawl portion for engaging with and holding the bin trays moved up to the sheet reception position are located on the front side of the bin trays. When the pawl portion is swung by reciprocal movement of a solenoid, the bin trays engaged with and held by the pawl are sequentially moved downward below the sheet reception position so that the sheets are selectively received in the bin trays. After the uppermost bin tray is moved downward, the (lowermost bin—1) bin trays are moved upward again to the sheet reception position.

U.S. Pat. No. 4,328,963 describes the following apparatus (to be referred to as a second prior art; see FIGS. 3 and 4 of the second prior art). In this apparatus, there are provided, at the front end side of the bin trays, disk-like transfer wheels 30 coupled to a motor and having transfer wheel slots to be respectively engaged with pins 17, extending on the side wall surfaces of bin trays 11, and arcuated guide slots 18 for guiding and supporting the bin trays through the pins. By utilizing the elastic force of coiled tension springs 10, the bin trays 11 are moved upward and are engaged with the pins. In this state, the transfer wheels 30 are rotated to guide the pins along the guide slots to increase a distance between each two adjacent bin trays while the bin trays are sequentially moved upward to the sheet reception position.

In the first prior art, a tray moving mechanism can be arranged by a simple mechanism to simplify the overall structure. However, the pawl and the rotary belt-like lift mechanism are arranged at the front surfaces of the bin trays. The overall length of the apparatus is inevitably increased. In addition, since the bin trays are moved while the tray engaged with the pawl is dropped, noise is increased by an impact force upon dropping of the bin tray. In the worst case, the bin trays are damaged.

In the second prior art, the transfer wheels are used to constitute a bin tray transfer mechanism. In addition, these transfer wheels are located on the wall at the side of the front ends of the bin trays. The overall length of the sorter is increased by a radius of curvature of the guide slots because the arcuated guide slots are formed to reciprocate the bin trays along the guide slots so as to facilitate engagement of the transfer wheel slots and the pins extending on the side wall surfaces of the bin trays.

In order to solve the above disadvantages, U.S. Pat. No. 4,466,608 proposes a mechanism having vertical linear guide slots. With this structure, the pins must be vertically and linearly moved along the guide slots although the transfer wheels are subjected to circular movement along the wheel slots. As a result, the pins cannot be smoothly guided.

When the pins are engaged with or disengaged from the wheel slots, the guide direction of the slot is preferably the same as the tangential direction of the corresponding transfer wheel. However, when the vertical linear guide slots are formed, as described above, the diameter of each transfer wheel must be increased to substantially match the tangential direction at the engagement or disengagement position with the vertical line. Alternatively, larger wheel slots must be increased to facilitate the engagement.

However, the former arrangement does not satisfy the request for minimizing the overall length of the sorter. The latter arrangement causes a difficulty in disengagement of the pins from the wheel slots toward the guide slots. As a result, smooth movement of the bin trays cannot be achieved. Either arrangement described above cannot solve the disadvantage of the second prior art.

In the second prior art, since the pins extending on the bin trays must be designed to be engageable with the wheel slots, the bin trays must be kept upward by using the elastic force of the springs, and hence the pins must be urged against the peripheral surfaces of the transfer wheels. However, degradation (fatigue caused by use for a long period of time) of the springs occurs. It is often difficult to urge the pins on the peripheral surfaces of the transfer wheels. As a result, smooth engagement of the bin trays with the wheel slots is disturbed.

Further, since the bin trays are biased by the elastic force of the springs, the line connecting the bin trays and the corresponding springs must be located on the front or side surface side of the sorter, and the resultant structure of the sorter is complicated.

In the second prior art, as shown in FIG. 5 therein, the portion for accommodating a motor for transmitting a rotational force to the transfer wheels greatly extends toward the side walls of the bin trays. As a result, the width of the sorter is increased, and hence the sorter itself becomes bulky.

SUMMARY OF THE INVENTION

It is an object of the present invention to provide a compact, low-cost sorter wherein the overall length and width of the sorter are only slightly larger than the dimensions of the bin trays, thereby reducing the size of the sorter.

It is another object of the present invention to provide a sorter wherein cost and noise are low and durability is improved by maximally simplifying a sorter mechanism.

It is still another object of the present invention to provide a sorter wherein bin trays can be accurately and precisely moved to a sheet reception position.

Other objects, features, and advantages of the present invention will be apparent from the following detailed description of a preferred embodiment.

In order to achieve the above objects of the present invention, there is provided a sorter having the following features (1) to (3), as shown in FIGS. 1 to 4:

(1) A drive means 38 such as a motor for applying a rotational force to moving means 55 to 57 is arranged in a lower space S1 of a storage section 40, which is away from the front end of the storage section 40 along the sheet travel direction. In this case, the front end opposes the sheet reception position P. Preferably, rotation control means 51 and 53 are additionally arranged in the drive means 38, and the drive means 38 can be rotated in the forward or reverse direction within the predetermined range of angles.

While the storage section 40 is inclined obliquely upward from the front end thereof along the sheet travel direction, the plurality of storage sections 40 are stacked and supported, and thus a space can be formed as the storage section lower space S1 away from the front end of the storage sections 40 along the sheet travel direction. The distance between the mounting position of the drive means 38 and the front ends of the storage sections 40 can be increased. In other words, the rotational radius of a link body constituting the moving means 55 to 57 can be increased, thereby providing the effects to be described later.

(2) The moving means 55 to 57 are disposed at side wall surfaces along the widthwise direction of the storage sections 40, the widthwise direction being perpendicular to the sheet travel direction. The moving means 55 to 57 are constituted by the link body including a link member 56 rotatably supported on the wall surface of a support frame extending along the side wall surfaces of the widthwise direction of the storage sections 40. The link body is located at an arbitrary position withdrawn from the front end of the storage section 40 along the side wall surfaces in the widthwise direction of the storage sections 40. The link body is then coupled to the uppermost storage section 40*a* at the withdrawn position.

(3) Adjacent storage sections 40 including the uppermost storage section 40 are coupled by a regulating member 59 for regulating a distance between each section and an adjacent one of the storage sections 40*b* to 40*e*. At the same time, a coupling point of the regulating member 59 is located near the front end of the storage section 40 with respect to a support point 36*a* where at least the plurality of storage sections 40 are stacked and supported.

The regulating member 59 can be constituted by a connecting plate having an elongated hole, and the elongated hole can be engaged with each pin extending on the side wall surface of the corresponding storage section 40.

According to the present invention, the following effects can be obtained:

(A) Since each storage section 40 is coupled to an adjacent one of the storage sections 40*b* to 40*e* by the regulating means 59 for regulating the distance therebetween, the plurality of storage sections 40 can be stacked and supported in the sorting preparation stage. In the storing stage, the link body is rotated upon reception of the rotational force of the drive means 38. The plurality of the storage sections 40 can be sequentially moved to a sheet reception position P and regulated by the regulating member 59 such that each storage section is separated from the adjacent one of the storage sections 40*b* to 40*e*.

In addition, the drive means 38 for commonly applying a rotational force to one end of each of the moving means 55 to 57 is disposed in the lower space S1 behind the storage sections 40. The moving means 55 to 57, constituted by the link body, can be freely expanded from the mounting position of the drive means 38 to the front ends of the storage sections 40 or the uppermost position of the storage section 40, since the space for the moving means 55 to 57 can extend substantially throughout the inner or outer wall of the sorter. The pivoting radius of the moving means 55 to 57 can be increased enough to move the lowermost storage section 40*e* upward to the sheet receiving position P. As a result, the storage sections 40 can be sequentially and precisely moved to the sheet reception position P without generating an impact force. Therefore, smooth sorting can be achieved, and a low-noise sorter having high durability can be provided.

Further, the connecting position of the regulating member 58 is located on the side of the front ends of the storage sections 40 with respect to the support point 36*a* where the plurality of storage sections 40 are stacked and supported. In other words, the connecting position of the regulating member 58 is located between the support point 36*a* and the front ends of the storage sections 40. The distance between each storage section 40 and an adjacent one of the storage sections 40*b* to 40*e* at the sheet reception position P can be larger than the regulating distance of the regulating member 59 at the connecting position. Therefore, sorting can be more accurately and precisely performed.

(B) As described above, the moving means 55 to 57 and the regulating member 59 can be disposed in the space K1 at the side of the wall surfaces of the storage sections 40 which are located behind the front ends of the storage sections 40. This disposition requires only a small number of components and does not require a large space. The front ends of the storage sections 40 can be near the sheet reception position P. As a result, the overall length of the sorter can be reduced. At the same time, additional transfer paths are not required to reduce the frequency of jam occurrence.

Since the radius of rotation of the moving means 55 to 57 for lifting the storage sections 40, coupled by the regulating member 59, can be increased, the front ends of the storage sections 40 can be vertically lifted along a vertical guide 37*a*. The front ends of the storage sections 40 can be located very close to the sheet reception position P, thereby improving the above effect further.

(C) According to the present invention, the space S1 formed below the storage sections 40 is utilized to dispose the drive motor which occupies a relatively large space. Therefore, a space for housing the drive motor along the widthwise direction of the storage sections 40 as in the second prior art can be omitted, and the width of the sorter can be greatly decreased.

Furthermore, the moving means 55 to 57 are constituted by a link body as a combination of plate-like members, and at the same time the moving means 55 to 57 are disposed in the space defined by the wall surfaces of the storage sections 40. Therefore, the sorter can be designed to have a width slightly larger than that of the storage section with a simple structure.

According to the present invention, therefore, sorting can be performed accurately and precisely without causing jam or the like. The sorter can be made compact, and the occupation space can be reduced.

According to the present invention, the moving means 55 to 57 for lifting the bin trays utilizing rotational force of the motor can be constituted by a simple structure. Other advantages such as low noise, high quality, and high durability can be provided.

BRIEF DESCRIPTION OF THE DRAWINGS

FIGS. 1 to 4 show a laser printer having a sorter according to an embodiment of the present invention, in which FIG. 1 is a sectional view showing the overall structure of the laser printer, FIG. 2 is a sectional view showing the planar arrangement of a sorter, FIG. 3 is a front sectional view showing moving means 55 to 57 for moving bin trays, and FIG. 4 is a front sectional view showing the relationship between position sensor moving means 55 to 57.

DETAILED DESCRIPTION OF THE PREFERRED EMBODIMENT

A preferred embodiment of the present invention will be described in detail with reference to the accompanying drawings. The sizes, materials, shapes, and relative positional relationships of the members constituting the laser printer in this embodiment do not restrict the scope of the invention but are exemplified only for the purpose of illustrative convenience unless otherwise specified.

Figure 1:
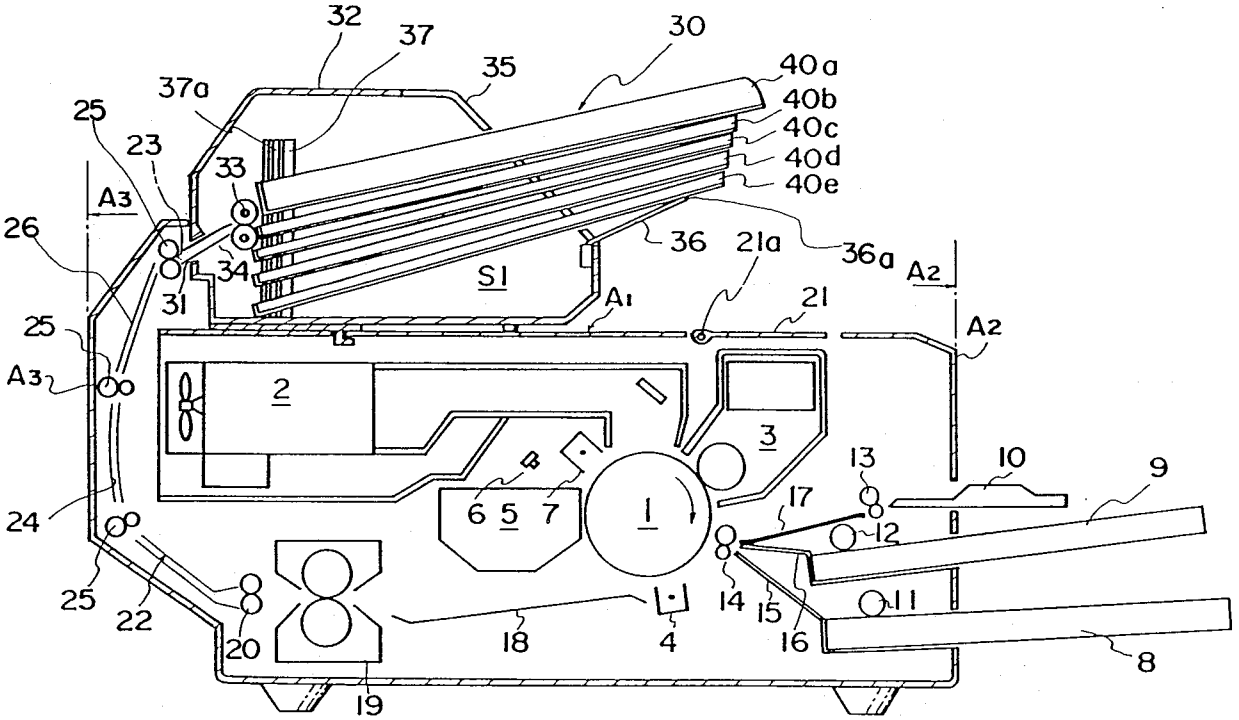
Figure 2:
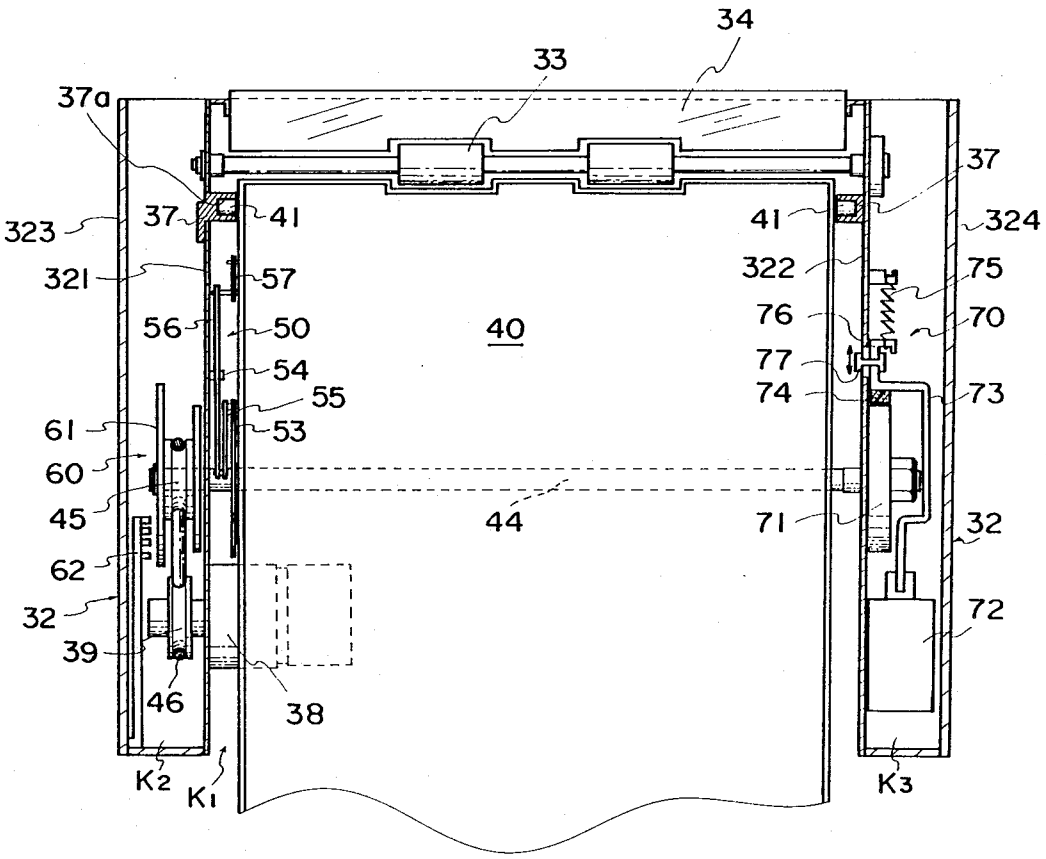

FIGS. 1 and 2 show a laser printer having a sorter according to an embodiment of the present invention.

The schematic structure of the laser printer will be described with reference to FIG. 1.

A photosensitive drum 1 is disposed at the center of the interior of the laser printer and can be rotated in a direction indicated by an arrow. An optical scanning unit 2 is disposed above the photosensitive drum 1 and is located near the exposure position of the photosensitive drum 1 with respect to the discharge direction.

A developing unit 3, a transfer unit 4, a cleaning unit 5, a discharge lamp 6, a charger 7, and the like are arranged around the photosensitive drum 1 along the rotational direction of the photosensitive drum 1. According to a known electrophotographic process, electrostatic latent images formed on the photosensitive drum 1 by the optical scanning unit 2 are repeatedly visualized. An openable cover 21 is mounted on an upper surface A1 above the developing unit 3 and is pivotal about a pivot shaft 21*a*. When the cover 21 is opened, the developing unit 3 can be replenished with a toner.

Two paper cassettes 8 and 9, having different sizes, and a manual feed mechanism 10 can be horizontally and sequentially attached to a side wall surface A2 on the feed side. Paper feed rollers 11, 12, and 13 are arranged at predetermined positions of the upper portion of the laser printer. Sheets can be fed to the inlet ends of register rollers 14 through corresponding feed paths 15, 16, and 17.

A convey guide 18, a fixing unit 19, discharge rollers 20, and a guide path for guiding the sheet to an discharge port 23 are arranged on the downstream side of the transfer unit 4.

The guide path is constituted by: guides 22, 24, and 26 arcuated and extended from the outlet end of the discharge rollers 20 along a side wall surface A3 to the upper position of the upper surface A1, and a roller pair 25 consisting of driving and driven rollers, disposed spaced apart from each other midway along the guides 22, 24, and 26 and at the end of the guide path. The sheet is discharged from a discharge port 23 formed at the end of the guide 26 in the direction toward the surface A2 on which the cassettes 8 and 9 are attached.

The sheet passing through the guide path is inverted from the face-up state to the face-down state and can be discharged from the discharge port 23. The mounting position of the discharge port 23 is located inside the side wall surface A3.

The discharge port 23 is formed at a position above the upper surface A1 and spaced therefrom by a predetermined distance. The discharge port 23 can oppose an inlet end 31 of the sorter. A distance between the opening end of the discharge port 23 and the cassette mounting side wall surface A2 located ahead of the discharge port 23 can be larger than the overall length of the sorter 30, i.e., a distance from the sorter inlet end 31 to the rear ends of the bin trays 40*a* to 40*e*. In this manner, the sorter can be made compact.

Figure 3:
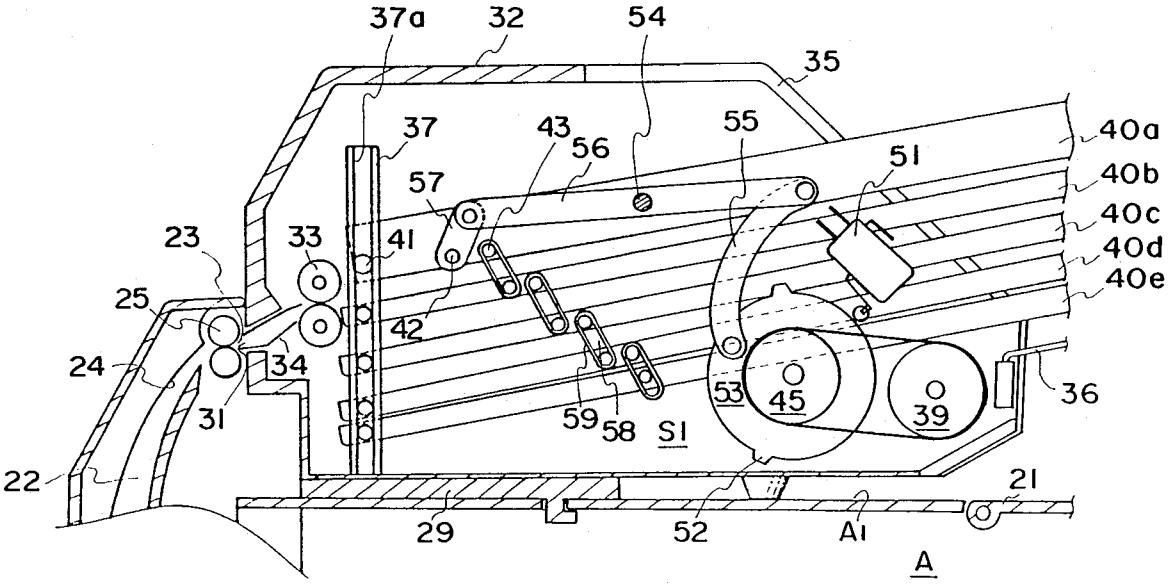
Figure 4:
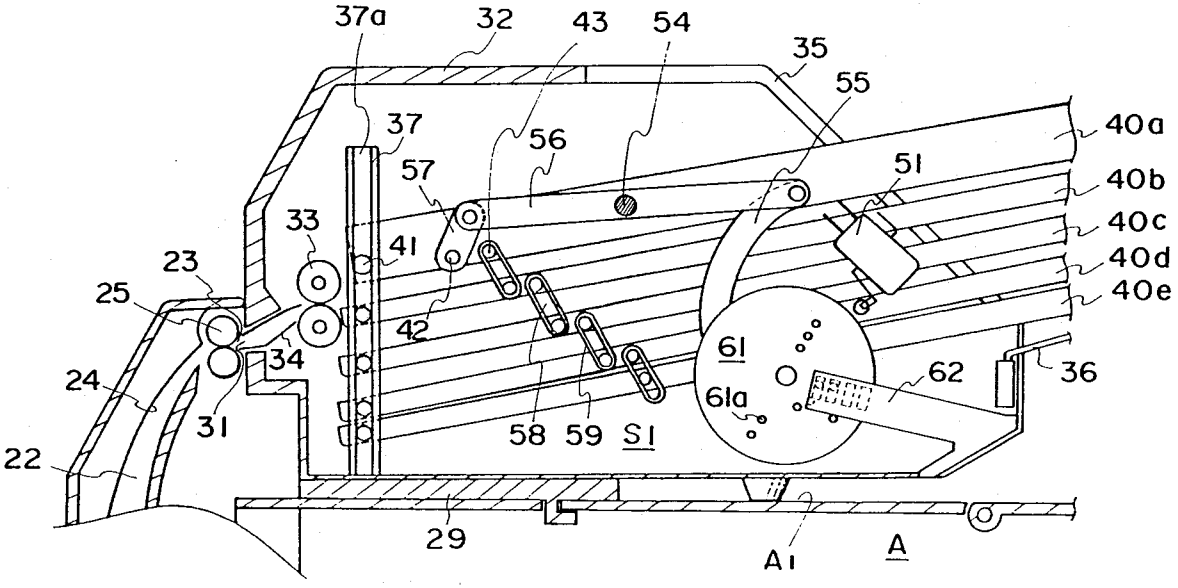

The structure of the sorter 30 will be described with reference to FIGS. 2 to 4.

Reference numeral 32 denotes a housing to be mounted on the upper surface A1 through a fixing plate 29. As shown in FIG. 2, the housing 32 comprises support frames 321 and 322 formed such that they extend parallel to the side wall surfaces of parallel bin trays 40*a* to 40*e* and various members can be mounted on their wall surfaces, and outer frames 323 and 324 spaced apart therefrom and located outside the support frames 321 and 322. An inlet end 31 opposite to the discharge port 23 of the housing 32 and a rear end 35 are open. A rod-like support member 36 is mounted on the rear end 35 and extends obliquely upward. The upper end position of the free end of the rod-like support member 36 serves as a pivot shaft 36*a* for pivoting the rear end portions of the lower surfaces of the bin trays 40*a* to 40*e* (FIG. 1).

A plurality (five) of bin trays 40*a* to 40*e* are mounted between the support frames 321 and 322 and extend obliquely upward. These bin trays can be supported by a support point 36*a* of the support member 36 and are thus stacked and inclined at a predetermined tilt angle, thereby forming a space S1 for receiving a drive motor 38 and the like in the withdrawn position between a portion below the bin trays 40*a* to 40*e* and the bottom of the housing 32.

Convey rollers 33 are arranged at the front ends of the bin trays 40*a* to 40*e*, and an insertion guide 34 is disposed at the opening of the opening of the inlet end 31 of the sorter. A sheet discharged from the discharge port 23 is guided to the inlet end of each of the bin trays 40*a* to 40*e* at the side of the outlet port of the convey rollers 33 through the insertion guide 34.

Each of the bin trays 40*a* to 40*e* has a rectangular shape so as to allow reception of rectangular sheets. The front end of each bin tray 40, which opposes the convey rollers 33, is recessed so that the bin tray is very close to the outlet port of the rollers 33. A pair of pins 41 extend from the side wall surfaces at the front end portion of each bin tray 40. Pins 42 and 43 extend from the side wall surfaces of the rear portion in a staggered manner. The depth of the uppermost bin tray 40*a* is larger than that of each of the remaining bin trays 40*b* to 40*e*. When sorting is not performed, the uppermost bin tray 40*a* can be used as a normal tray so that a large number of sheets can be stacked thereon.

Tray guides 37 are fixed on the support frames 321 and 322 opposite to the pair of pins 41, respectively. The pins 41 are fitted in vertical guide grooves 37*a* formed in the tray guides 37. The bin trays 40*a* to 40*e* can be vertically moved along the vertical guide grooves 37i a while the trays 40*a* to 40*e* are supported by support points 36*a* of the rod-like support member 36.

The drive motor 38 and a rotating shaft 44 rotated upon reception of the rotational force from the motor 38 through a pulley 39 are arranged in a space S1 defined by the bin trays 40*a* to 40*e* behind the support frames 321 and 322 and the bottom portion of the housing 32. A moving means 50, (55 to 57) for lifting the bin trays 40*a* to 40*e* to the outlet end position (to be referred to as a sheet reception position P) of the convey rollers 33, is arranged in a space K1 defined by the support frame 321 and the side wall surfaces of the bin trays 40*a* to 40*e*. A transmission system consisting of pulleys 39 and 45 and a belt 46, and a positioning sensor 60 for detecting lifting positions of the bin trays 40*a* to 40*e* are arranged in a space K2 defined between the outer support frame 321 and the outer frame 323. A braking means 70, for sequentially locking the bin trays 40*a* to 40*e* at the sheet reception position, in response to a signal from the positioning sensor 80, is arranged in a space K3 defined between the support frame 322 and the outer frame 324.

It should be noted that a transmission system for transmitting a rotational force of the drive motor 38 may be constituted by a gear train in place of a combination of the pulleys and the belt.

Both ends of a rotating shaft 44, suspended between the support frames 321 and 322, extend to the spaces K2 and K3 defined between the support frames 321 and 322 and the outer frames 323 and 324. A sensor disk 61 and a pulley 39 are arranged in the space K2. A disk 53 is arranged in the space K1 to apply the rotational force to the moving means 50 (55 to 57). A disk 71 is arranged in the space K3. Therefore, the above components are rotated together upon rotation of drive motor 38.

It should be noted that the moving means 50 can be arranged at the side wall in the widthwise direction of the bin tray 40.

The moving means (55 to 57) is constituted by a link body rotated upon reception of a rotational force applied from the disk 53 rotated by forward/reverse rotation of the motor 38 through the pulleys 39 and 45. The link body comprises a first link member 56 the central portion of which is pivoted through a shaft 54 fixed on the support frame 321, a second link member 55 for connecting one end of the first link member 56 and the disk 53, and a third link member 57 for connecting the other end of the first link member 56 and the front end of the bin tray 40*a* through the pin 42.

Pins 43 respectively extend from the side wall surfaces of the bin trays 40*a* to 40*e*. When each pin 43 is engaged with an elongated hole 58 of each connecting plate 59, so that the adjacent ones of the bin trays 40*a* to 40*e* are connected through the connecting plates 59.

In this case, the elongated holes 58 are used to define the distance between the adjacent ones of the bin trays 40*a* to 40*e* during sorting. The major axis of each elongated hole 58 is set to be a length obtained by the following relation [(Proper Space at Front Ends of Bin Trays 40*a* to 40*e*)—(Distance from Support Point 36*a* to Connecting Position of Regulating Member 59)/(Distance from Support Point 36*a* to Vertical Guide Groove 37*a* at Front Ends of Bin Trays 40)].

In the sorting preparation stage, the plurality of bin trays 40*a* to 40*e* are stacked and supported. At the time of sorting, the disk 53 is rotated upon reception of a rotational force of the motor 38, and the second and first link members 55 and 56 are pivoted upon rotation of the disk 53. The uppermost bin tray 40*a* is moved upward through the third link member 57, and the connecting plate 59 is independently moved by the length of the major axis of the elongated hole 58, thereby widening the distance between the bin tray 40*a* and the next bin tray 40*b*. The next bin tray 40*b* is pulled by the connecting plate 59 and can be moved upward along the vertical guide grooves 37*a* in the same manner as in the above operation.

Since the disk 53, the second link member 55, the first link member 56, the third link member 57, and the connecting plate 59 are made of plate-like members, they can be disposed in the spaces with a sufficient margin. In addition, since no interfering member is arranged above the lowermost bin tray 40*e* in the space K1, the radius of rotation of the first link member 56 can be increased. Even if the bin trays 40*a* to 40*e* are vertically pivoted, no excessive force is applied to the members 53 to 59 constituting the moving means 55 to 57 (50).

Reference numeral 51 denotes a limit switch arranged at a predetermined position around the disk 53. The limit switch 51 allows forward or reverse rotation of the motor 38 when the switch 51 is operated by one of dogs 52 extending on the edge of the disk 53 at predetermined angular positions. However, a mechanical stopper may be arranged in place of the limit switch 51 to control limitations.

A positioning sensor 60 comprises a sensor disk 61 having radial positioning detection apertures 61*a* at predetermined angular positions, and a detector 62 for detecting the position of the detection aperture 61*a*. The angular position of the sensor disk 61 which corresponds to the attachment positions of the bin trays 40*a* to 40*e* according to the positions of the detector 62 and the detection apertures 61*a* is detected. An actuation signal is output to a solenoid 72 constituting a braking means 70.

The braking means 70 comprises the solenoid 72, a brake shoe 74 opposite to a disk 71, a connecting plate 73 for transmitting reciprocal movement of the solenoid 72 to the brake shoe 74, a tension spring 75 for biasing the connecting plate 73 backward, and a position regulating pin 77 engaged with an elongated hole 76 formed in the support frame 322. The brake shoe 74 locks the disk 71 upon actuation of the solenoid 72, so that the bin trays 40*a* to 40*e* are sequentially positioned and fixed to the sheet reception position.

It should be noted that the solenoid 72 as the braking means 70 may comprise, for example, an electromagnetic braking mechanism. Alternatively, a stepping motor in place of the braking means 70 may be used as the bin tray moving motor 38. In this case, the motor 38 is rotated by a predetermined angle under electrical control, and the bin trays 40*a* to 40*e* can be sequentially positioned and fixed to the sheet reception position.

The operation of the movable tray sheet sorter having the arrangement described above will be described below.

A sheet selectively fed from the paper cassette 8 or 9 or a manual feed mechanism 10 is fed to an image transfer position on the photosensitive drum 1 while the register rollers 14 are rotated in synchronism with the leading edge of the image on the photosensitive drum 1. A nonfixed toner image carried on the photosensitive drum 1 is transferred to the sheet by the transfer unit 4.

The sheet having a nonfixed toner image passes through the convey guide 18 and is fed to the fixing unit 19. The nonfixed tone image is fixed by the fixing unit 19, and the sheet having the fixed image is guided in the guide 22 by the discharge rollers 20. Upon rotation of the roller pair 25, the sheet is inverted while it passes through the guides 24 and 26. The faced down sheet is conveyed to the discharge port 23.

The sheet discharged from the discharge port 23 reaches the convey roller 33 through the insertion guide 34 from the side of the sorter inlet end 31. Upon rotation of the convey rollers 33, the sheet is further fed and stored in the uppermost bin tray 40*a*.

When the sheets are not sorted, the above operation is repeated.

However, in the sorting mode, discharge of the sheet from the convey rollers 33 is detected by a sensor (not shown), and the motor 38 is rotated by a predetermined angle.

Upon rotation of the motor 38, the rotating shaft 44, the disk 53, the second link member 55, and the first link member 56 are rotated by a predetermined angle. The uppermost bin tray 40*a* is moved upward along the vertical guide grooves 37*a* through the third link member 57. Subsequently, the connecting plate 59 is independently moved upward by a distance corresponding to the major axis of the elongated hole 58, thereby widening the distance between the bin tray 40*a* and the next bin tray 40*b*. Thereafter, the bin tray 40*b* is pulled by the connecting plate 59, and the bin tray 40*b* is moved upward to a position opposite to the convey rollers 33.

An actuation signal is sent from the positioning sensor 60 to the solenoid 72 to actuate the brake shoe 74, thereby locking the disk 71. In this state, the bin tray 40*b* is positioned and fixed through the rotating shaft 44 and the moving means 55 to 57 (50), and the motor 38 is stopped.

After the sheet is stored in the bin tray 40*b*, the motor 38 is again rotated. The same operation as described above is repeated to sequentially store the sheets up to the lowermost bin tray 40*e*.

When the lowermost bin tray 40*e* is moved upward to the position opposite to the convey rollers 33, the dog 52 formed on the edge of the disk 53 urges the limit switch 51 to rotate the motor 38 in the reverse direction. In this case, the sheets are sequentially stored in the bin trays from the lowermost bin tray 40*e*.

According to this embodiment, the bin trays 40*a* to 40*e* can be located near the convey rollers 33, and thus the overall length of the sorter can be decreased. At the same time, the frequent occurrence of jam can be prevented. The drive motor 38 having a large occupation size can be arranged in the space S1 below the bin trays 40*a* to 40*e*. Therefore, the sorter can be made compact, and its width can also be greatly decreased.

The spaces K1, K2, and K3 are small but can be formed substantially throughout the entire inner walls of the sorter. Therefore, the moving means 55 to 57 (50), the position sensor 60, the braking means 70, and the like can be effectively stored in the entire length of the sorter 30. Therefore, the overall width of the sorter 30 can be reduced.

Furthermore, according to this embodiment, the position sensor and the braking means are respectively arranged in the both side spaces K2 and K3 outside the bin trays. Therefore, the spaces K2 and K3 can be kept narrow.

What is claimed is:

1. A sorter for sequentially moving a plurality of vertically stacked storage sections having vertical walls to a sheet reception position by moving means which is moved upon reception of a rotational force of driving means and for automatically sorting sheets discharged from an image forming apparatus into said plurality of storage sections, wherein said moving means is disposed inside a wall surface in a widthwise direction of each storage section, the widthwise direction being perpendicular to a sheet travel direction, said driving means is disposed in a space below said storage sections, the space being away, along the sheet travel direction, from a front end of one of said plurality of storage sections which opposes a sheet reception position, said sorter further comprises a support frame having a wall surface and wherein said moving means comprises a link body including one link member pivotally supported on the wall surface of the support frame extending along the wall surface in the widthwise direction of each storage section, said link body extends to any position backward from the front end of each storage section and is connected to an uppermost one of the storage sections, said sorter further comprising a plurality of regulating members, each regulating member for connecting a storage section including said uppermost storage section to an adjacent one of said storage sections and for regulating a distance between two adjacent storage sections, a connecting position of said regulating member is located near the front end of each storage section with respect to at least a support point for stacking and supporting said plurality of storage sections.

2. A sorter according to claim 1 further comprising a vertical guide wherein the front end of each storage section is vertically movable along the vertical guide.

3. A sorter according to claim 2 wherein rotation control means is added to said drive means, for causing said drive means to be rotated in a forward or reverse direction within a predetermined rotational angle range.

4. A sorter according to claim 1 wherein rotatin control means is added to said drive means, for causing said drive means to be rotated in a forward or reverse direction within a predetermined rotational angle range.

5. A sorter according to any one of claims 1–4 and 3 wherein said plurality of storage sections are stacked and supported while said plurality of storage sections extend from the front end of each storage section and are obliquely inclined along the sheet travel direction, thereby forming the space for receiving the drive means, the space being away from the front end of each storage section along the sheet travel direction.

6. A sorter according to claim 5 wherein said regulating member for connecting two adjacent storage sections comprises a connecting plate having an elongated hole, said elongated hole being engaged with each pin extending on a side wall surface of each storage section.

7. A sorter according to any one of claims 1–4 and 3 wherein said regulating member for connecting two adjacent storage sections comprises a connecting plate having an elongated hole, said elongated hole being engaged with each pin extending on a side wall surface of each storage sections.

* * * * *